US008251218B2

(12) United States Patent
Gelardi

(10) Patent No.: US 8,251,218 B2
(45) Date of Patent: Aug. 28, 2012

(54) CONTAINER WITH PIVOTING COVER

(75) Inventor: John Gelardi, Wake Forest, NC (US)

(73) Assignee: MeadWestvaco Corporation, Richmond, VA (US)

( * ) Notice: Subject to any disclaimer, the term of this patent is extended or adjusted under 35 U.S.C. 154(b) by 490 days.

(21) Appl. No.: 12/518,494

(22) PCT Filed: Dec. 10, 2007

(86) PCT No.: PCT/US2007/025198

§ 371 (c)(1),
(2), (4) Date: Jun. 10, 2009

(87) PCT Pub. No.: WO2008/073360

PCT Pub. Date: Jun. 19, 2008

(65) Prior Publication Data

US 2010/0084424 A1 Apr. 8, 2010

Related U.S. Application Data

(60) Provisional application No. 60/874,430, filed on Dec. 12, 2006.

(51) Int. Cl.
*B65D 83/04* (2006.01)
*B65D 85/42* (2006.01)

(52) U.S. Cl. ..... 206/540; 206/534.2; 206/810; 220/324; 220/835; 220/840; 220/282; 220/315; 220/810; 221/306

(58) Field of Classification Search ..... 206/810, 206/540, 534.2; 220/282, 324, 835, 840, 220/315, 810; 221/306
See application file for complete search history.

(56) References Cited

U.S. PATENT DOCUMENTS

| | | | | | |
|---|---|---|---|---|---|
| 1,369,819 | A * | 3/1921 | Krause | 220/282 |
| 2,026,463 | A * | 12/1935 | Driess | 220/282 |
| 2,035,246 | A | 3/1936 | Rea | |
| 2,219,487 | A * | 10/1940 | Nyden | 206/534.2 |
| 2,307,087 | A * | 1/1943 | White | 220/283 |
| 2,492,864 | A * | 12/1949 | Hermani | 206/540 |
| 3,591,043 | A | 7/1971 | Murphy | |
| 3,894,654 | A * | 7/1975 | Frankenberg | 220/283 |
| 4,807,778 | A * | 2/1989 | Lo | 220/282 |
| 6,041,975 | A | 3/2000 | Flak | |
| 7,938,266 | B2 * | 5/2011 | Cross | 206/540 |
| 7,938,267 | B2 * | 5/2011 | Cross | 206/540 |
| 7,939,819 | B2 * | 5/2011 | Aoki | 257/40 |

FOREIGN PATENT DOCUMENTS

| | | |
|---|---|---|
| WO | WO2008024358 | 2/2008 |
| WO | WO2008070032 | 6/2008 |

* cited by examiner

*Primary Examiner* — Gene O. Crawford
*Assistant Examiner* — Rakesh Kumar
(74) *Attorney, Agent, or Firm* — MWV Intellectual Property Group

(57) ABSTRACT

Disclosed is a package for storing a product, such as smokeless tobacco, which includes, inter alia, a container that has opposing upper and lower surfaces, and a container sidewall that extends between the upper and lower surfaces to define an interior for storing a plurality of products. The upper surface of the container has an apex intermediate a first region and a second region and the container sidewall defines an opening sized and configured to release at least one of the products. The package also includes an outer cover having an upper section and a cover sidewall depending from the upper section. The outer cover is configured to retain the container and selectively seal the opening. The container pivots about the apex to transition between open and closed positions.

9 Claims, 6 Drawing Sheets

CONTAINER WITH PIVOTING COVER

This application is a 35 U.S.C. §371 patent application of an International Patent Application No. PCT/US2007/025198 (expired) filed on Dec. 10, 2007, which claims priority from U.S. Ser. No. 60/874430 (expired) filed on Dec. 12, 2006, wherein the entire contents of PCT/US2007/025198 and U.S. Ser. No. 60/874430 are incorporated herein by reference.

BACKGROUND OF THE INVENTION

1. Field of the Invention

The present invention relates generally to product packaging, and more particularly to packaging for storing a product in a sealed environment, and still more particularly to a packaging assembly that includes a cover that pivots between open and closed positions upon the application of a compressive force.

2. Background of the Related Art

The widespread use of smokeless tobacco products has become prevalent around the world. Most smokeless tobacco products are sold in circular cardboard and metal or molded plastic cans having a paper seal enclosing them. This particular form of tobacco is normally referred to as snuff or finecut moist smokeless tobacco. When a user desires to use the product, the paper seal is broken, the lid is removed, and the desired amount of smokeless tobacco is removed from the can for enjoyment. The lid is then replaced until further use is desired.

Almost all commercially available smokeless tobacco cans, however, make using smokeless tobacco a cumbersome experience. The two-piece construction of almost all cans makes opening of the lid, removal of a serving of chewing tobacco, and reclosing of the lid a two-handed proposition. Holding a conventional can and lid in one hand while trying to remove a serving of tobacco with the other can be cumbersome and lead to spilling of the product.

Furthermore, the inexpensive construction of the conventional smokeless tobacco cans and the repeated opening and closing of the conventional lids cause the lids to deform easily and become loose. Thus, once the paper seal is broken, the conventional cans and lids fail to provide the tight seal required to retain the flavor and freshness of the tobacco and are known to cause unwanted spills.

Still further, the finecut of the tobacco presents a hygienic issue in that soil or other contaminants on the fingertips become dispersed within the container and the fingertips become soiled by the tobacco. Additionally, even the most experienced users can inadvertently swallow portions of the tobacco and have difficulty and messy experiences in removal after use. To over come some of these drawbacks, single serving packets of tobacco (e.g., snus packets) have been developed. In the single serving packets, a typical portion is sealed in a flow through bag which allows for enjoyment of the product yet allows easy and relatively hygienic acquisition from the container, usage and removal.

However, traditional packaging for snus packets, requires users to remove the product directly with the fingers and place it in the desired location in the mouth. Thus, consumption of smokeless tobacco can still be unhygienic. It is possible for bacteria, contagions, and other pathogens to communicate from the fingers to the membranes of the mouth either directly or via the product.

What is needed is an improved container for smokeless tobacco and other products that minimizes the above-mentioned shortcomings associated with conventional product containers. More specifically, there is a need for an improved container that is easier to use and allows for more hygienic dispensing or consumption of the product.

SUMMARY OF THE INVENTION

Despite the advances noted above, there is still a need for an improved container for smokeless tobacco and other like products that minimizes the shortcomings associated with conventional product containers. More specifically, there is a need for an improved container that is easy to use, retains the integrity of the product longer by providing a better seal than conventional cans and is cost effective to manufacture.

Preferably, the subject technology provides a package that is simple and pleasing to use, controls dispensing, provides a barrier seal, and is cost effective to manufacture.

The subject disclosure provides a package for storing a product, such as smokeless tobacco, which includes, inter alia, a container that has opposing upper and lower surfaces, and a container sidewall that extends between the upper and lower surfaces to define an interior for storing a plurality of products. The upper surface of the container has an apex intermediate a first region and a second region and the container sidewall defines an opening sized and configured to release at least one of the products.

The package also includes an outer cover having an upper section and a cover sidewall depending from the upper section. The outer cover is configured to retain the container and selectively seal the opening. The container pivots about the apex to transition between open and closed positions. In the closed position, the first region of the upper surface of the container is flush against the upper section of the outer cover and the cover sidewall of the outer cover seals the opening in the container sidewall. In the open position, the second region of the upper surface of the container is flush against the upper section of the outer cover and the opening in the container sidewall extends beyond the cover sidewall and the products can be dispensed.

In certain embodiments, the container includes a flange around the opening in the container side wall to sealingly engage the cover sidewall. Moreover, it is presently preferred, but not required, that the upper section of the outer cover has a first finger recess formed above the first region which facilitates closing the package and a second finger recess formed above the second region which facilitates opening the package.

It is envisioned that in certain embodiments of the present invention, the apex of the container includes a socket for engaging a ball on the upper section to retain the inner container within the outer cover. In other constructions, the package has at least one tab on the outer cover for retaining the container therein. Moreover, the at least one tab can be flexed between an unassembled position and an assembled position. Still further, in certain constructions the at least one tab can be include two tabs along a center line formed by the apex. However, it is envisioned that when the package is rectangular the at least one tab can include four tabs, one on each side of the outer cover.

The package is particularly adapted from products, such as for example, bagged snuff, mints, and chewing gum. The package can be rectangular, square, round, polygonal and combinations thereof. Preferably, the inner container is plastic and the outer cover is tin, paper or plastic.

The inner container can also include at least one rib formed on the apex. Moreover, the sidewall of the inner container can be beveled and form a point and a coating can be applied to at least one of the flange and the point. Still further, the sidewall of the outer cover define at least one detent for engaging the point.

The present disclosure is also directed to a package for storing and dispensing a product that includes, inter alia, a container and an outer cover. The container has a bottom surface and a container sidewall that extends around the periphery of the bottom surface to define an interior for storing a plurality of products. Additionally, opposed lateral portions of the container sidewall each include an apex and an end portion of the container sidewall defines an opening sized and configured to allow the products to pass through.

The outer cover that includes an upper section and a cover sidewall depending from the upper section and is configured to retain the container and selectively seal the opening. The cover is adapted and configured for pivoting about the apex of the opposed lateral portions of the container sidewall between open and closed positions. In the closed position the cover sidewall seals the opening in the container sidewall and in the open position wherein the opening formed in the end portion of the container sidewall is exposed and products can be dispensed.

In certain embodiments, the container includes an upper surface that has an apex portion that extends between the apex of each of the lateral portions of the container side wall. Still further, it is envisioned that the container can include a flange around the opening in the container side wall to sealingly engage the cover sidewall.

The present disclosure is also directed to a package for storing and dispensing that includes, among other elements, a container and an outer cover. The container has a bottom surface and a container sidewall that extends around the periphery of the bottom surface to define an interior for storing a plurality of products and an upper surface for the container. The container sidewall defines an opening for dispensing product stored within the interior of the container.

The outer cover includes an upper section and a cover sidewall that depends from the upper section. The outer cover is configured to retain the container and pivot with respect to the container between a closed position and an open position, wherein in the closed position the cover sidewall seals the opening formed in the end portion of the container sidewall and in the open position the opening formed in the end portion of the container sidewall is exposed and products can be dispensed.

BRIEF DESCRIPTION OF THE DRAWINGS

So that those having ordinary skill in the art will better understand how to make and use the containers of the subject invention, embodiments thereof will be described below with reference to the following drawings.

Figure 1:
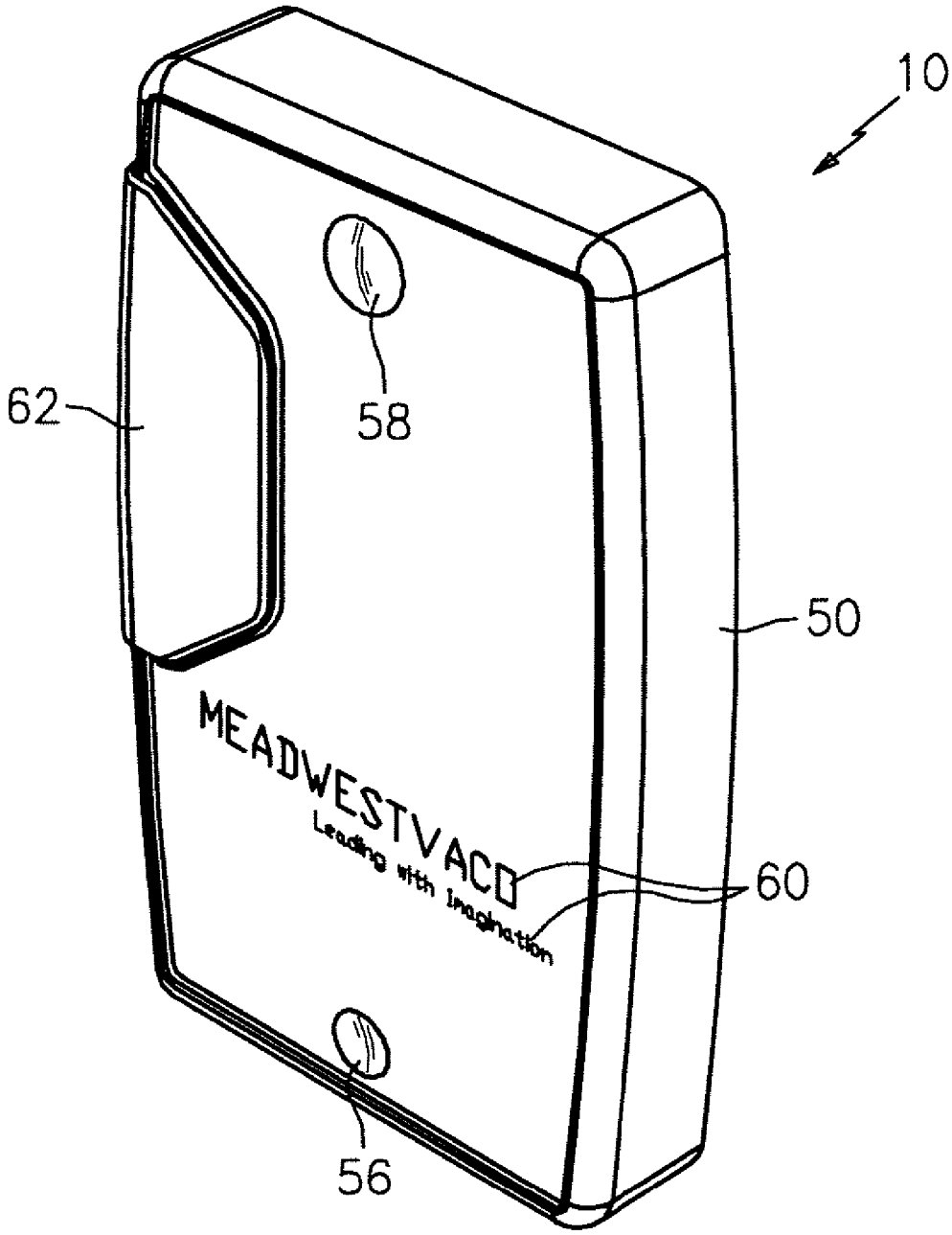
FIG. 1 is a perspective view of a branded package that is constructed in accordance with a preferred embodiment of the present invention.

These and other aspects of the subject invention will become more readily apparent to those having ordinary skill in the art from the following detailed description of the preferred embodiments of the invention taken in conjunction with the figures.

DETAILED DESCRIPTION OF THE PREFERRED EMBODIMENTS

Reference is now made to the accompanying figures for the purpose of describing, in detail, preferred and exemplary embodiments of the present disclosure. The figures and detailed description are provided to describe and illustrate examples in which the disclosed container may be made and used, and are not intended to limit the scope thereof. Those skilled in the art will readily appreciate that the disclosed containers can be used to store a variety of products. More specifically, the disclosed containers can be used for the storage of products, such as for example, smokeless tobacco, cigarettes, confectionary, cigarettes, tea bags or any product stored in a pouch, mints, and the like without departing from the inventive aspects of the present disclosure.

Referring now to FIGS. 1 through 7, there is illustrated a package for storing a product, such as smokeless tobacco, which has been constructed in accordance with an exemplary embodiment of the present invention and designated generally by reference numeral 10. The package 10 includes an inner container 20 and an outer cover 50. In FIGS. 2-7, many internal structural details of the package 10 are shown in phantom line for clarity.

Figure 6:
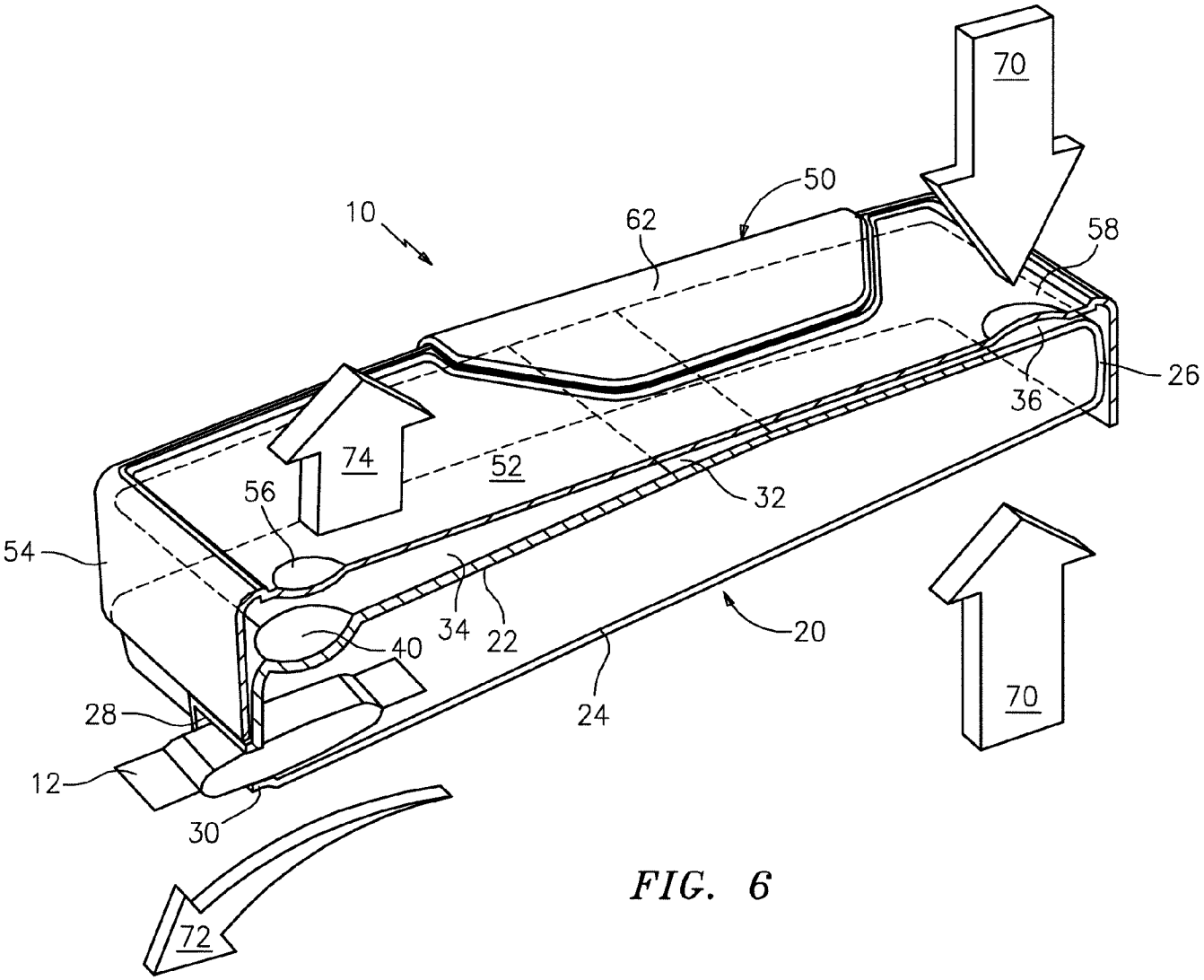
FIG. 6 is a perspective, sectional view of the package of FIG. 1, wherein the package is in the open position.
Figure 7:
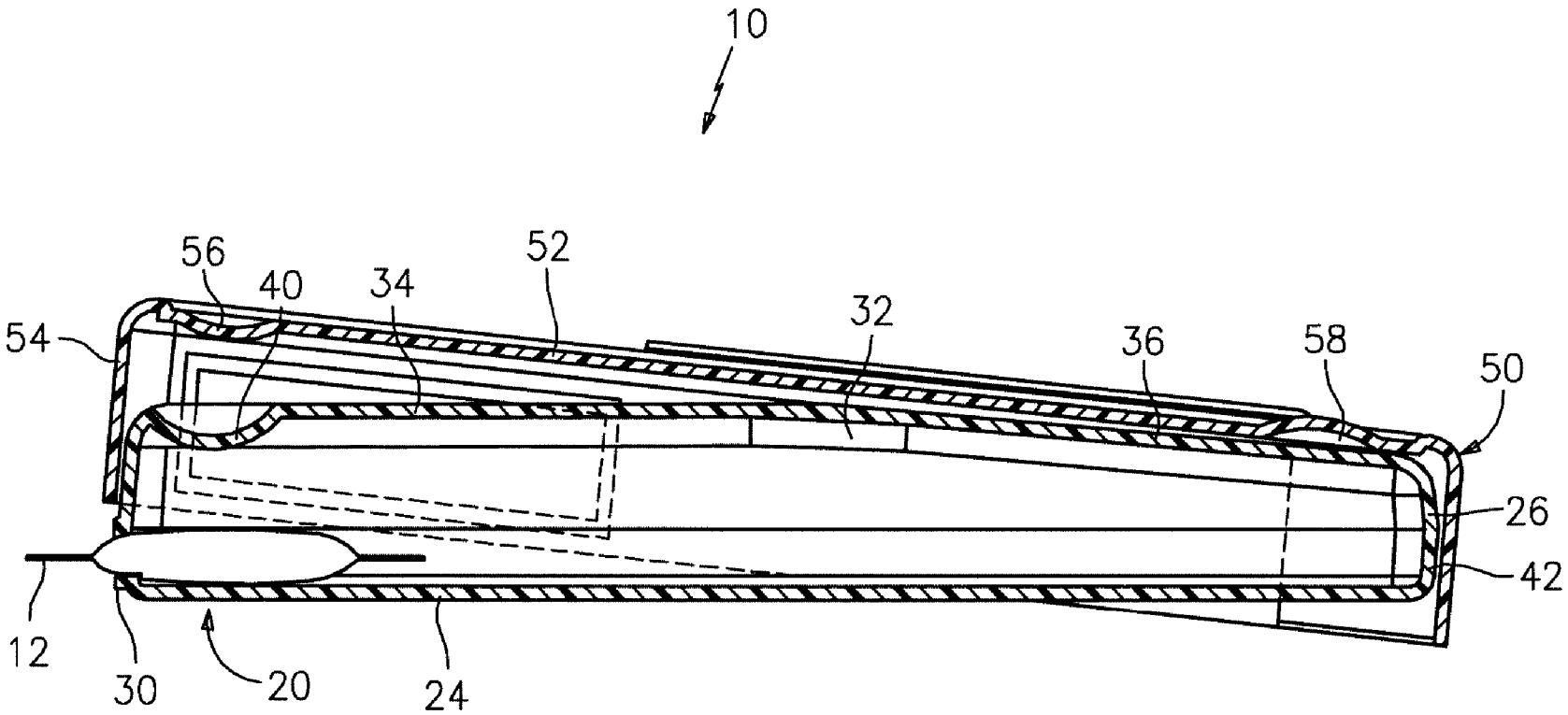
FIG. 7 is a side, sectional view of the package of FIG. 1, wherein the package is in the open position.

As best viewed in FIGS. 6 and 7, the inner container 20 of package 10 has opposing upper and lower surfaces 22, 24 and a sidewall 26 extending between the upper and lower surfaces 22, 24 to define an interior for storing a plurality of products 12. It will be readily appreciated that the inner container 20 and outer cover 50 of the package 10 can be formed as a monolithic structure or can be formed using two or more parts/elements without departing from the inventive aspects of the present disclosure. Additionally, the methods used to join the parts can vary and include, for example, fasteners, interlocking structures, welding and/or adhesives.

As shown herein, the inner container 20 of the package 10 is molded or formed as a monolithic unit. Typically, the inner container 20 of package 10 would be made from a polymeric material, such as plastic, and can be formed using a process, such as injection molding, but the inner container 20 and package 10 may be formed from any other suitable rigid material and from any number of parts.

An opening 28 is provided in the sidewall of the inner container 20 of the package 10 through which product 12 housed within internal product storage compartment can be accessed or dispensed. The products 12 can be neatly packed or loosely packed to allow movement within the inner container 20. A flange 30 surrounds the opening 28 to provide a sealing surface for engaging the outer cover 50.

Figure 2:
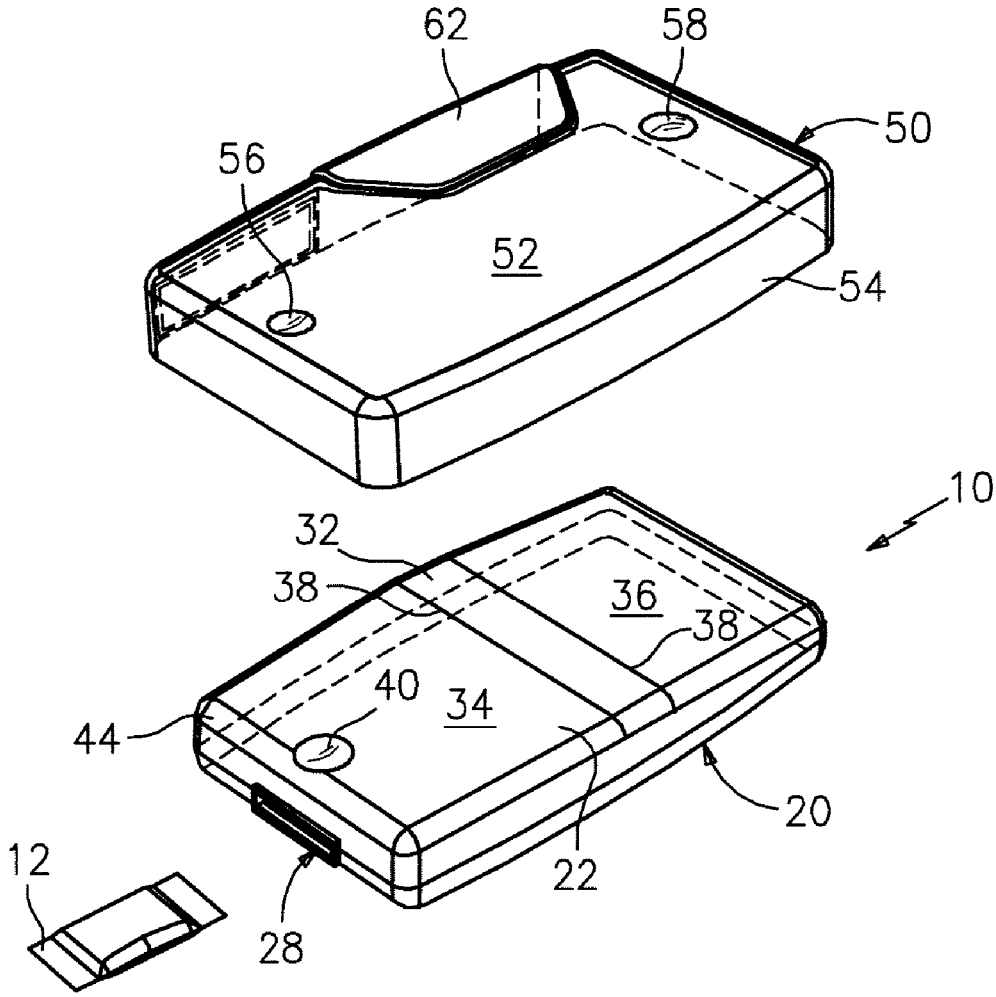
FIG. 2 is an exploded perspective view of a package that is constructed in accordance with a preferred embodiment of the present invention.
Figure 3:
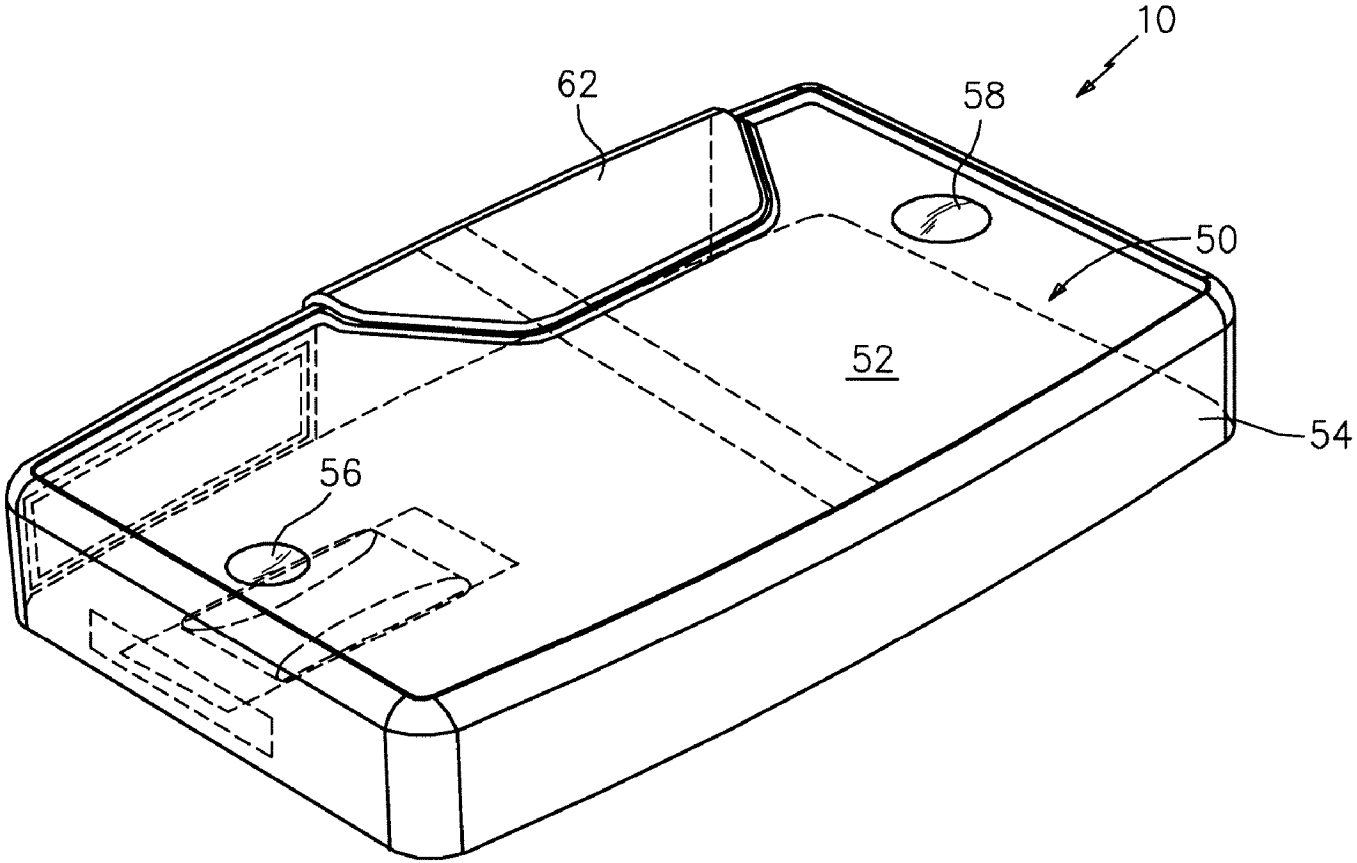
FIG. 3 is a perspective view of the front of a package of FIG. 1, wherein the package is in the closed position.

As best seen in FIG. 2, the upper surface 22 of the inner container 20 has an apex region 32 intermediate a first region 34 and a second region 36. The apex region 32 preferably forms a peak. In other words, the first and second regions 34, 36 are slanted away from the apex region 32 such that the upper surface 22 is not planar. In a preferred embodiment, the first region 34 is substantially parallel to the lower surface 24 and only the second region 36 is slanted. In one embodiment, the apex region 32 includes two raised ribs at the junction 38 between areas to facilitate opening and closing the package 10 as is described below.

The outer cover 50 holds the inner container 20 of package 10 and selectively seals the opening 28. The outer cover 50 includes an upper section 52 with a depending sidewall 54. The outer cover 50 has a first finger recess 56 formed above the first region 34, which facilitates closing the package 10 and a second finger recess 58 formed above the second region 36, which facilitates opening the package 10. The upper surface 22 of the inner container 20 has a corresponding finger recess 40 to prevent undesirable interference with the operation of the package 10.

The inner container 20 nests within the outer cover 50. In one embodiment, the outer cover 50 has one or more tabs (not shown) for retaining the inner container 20 therein. The tabs are preferably integrally formed with the outer cover 50 and flex between an open unassembled position in which the inner container 20 is easily placed therein and a closed assembled position in which the inner container 20 is restrained therein. In one embodiment, the outer cover 50 only has two tabs adjacent the apex region 32. In another embodiment, the outer cover 50 has four tabs, one on each side of the outer cover 50. When nested, the apex region 32 contacts the outer cover 50 to form a rocking mechanism as discussed below.

As shown in FIG. 1, the outer cover 50 also includes a graphic/logo 60 for the stored product. If desired, a breakable seal 62 may also be included to show evidence of tampering prior to sale, authentication of product and the like. The breakable seal 62 also helps to further protect the product 12 during long-term storage or shipment. Typically, prior to accessing the product 12 for the first time, the breakable seal 62 is at least partially removed and discarded.

Figure 5:
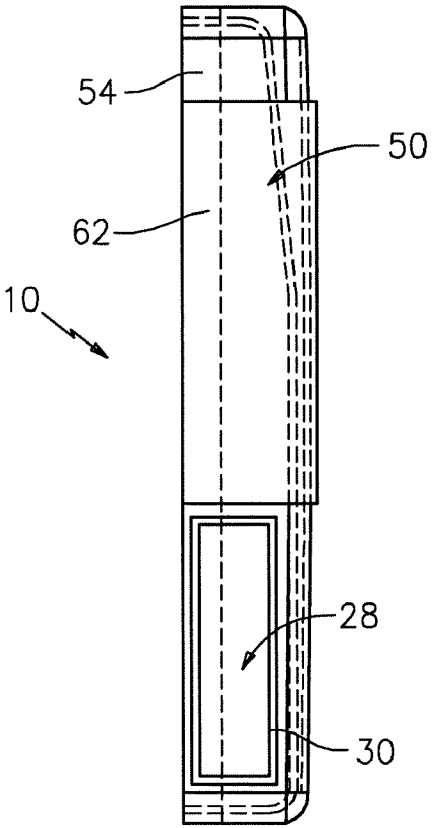
FIG. 5 is a plan view of the side of the package of FIG. 1, wherein the package is in the closed position.
Figure 4:
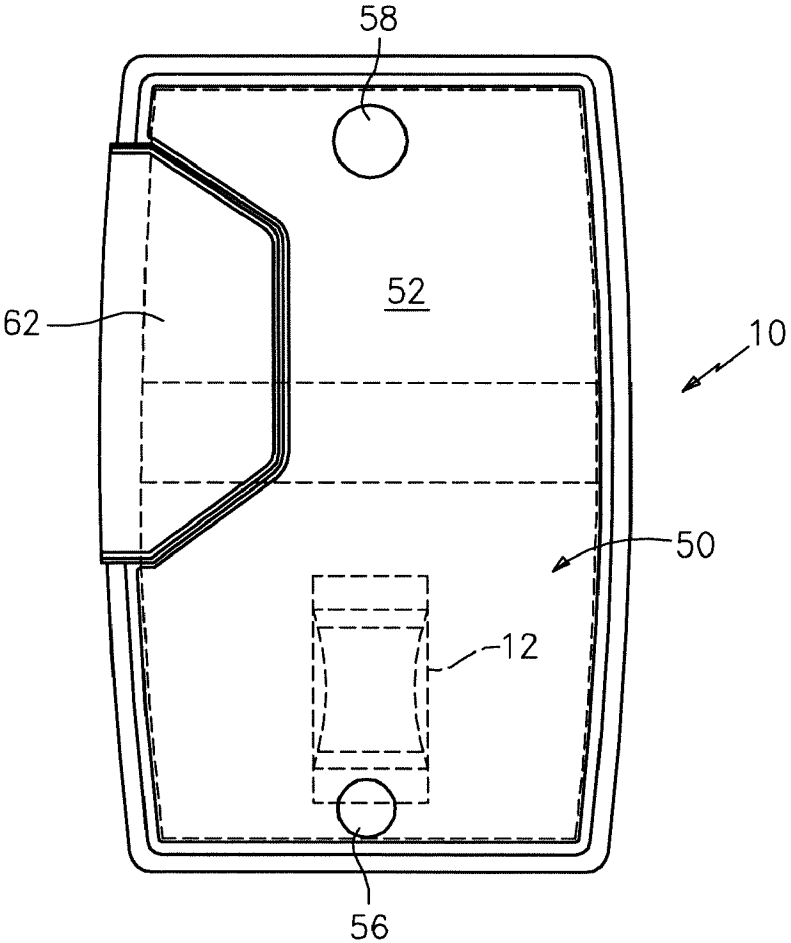
FIG. 4 is a plan view of the front of the package of FIG. 1, wherein the package is in the closed position.

In a closed position best seen in FIG. 5, the first region 34 is flush against the upper section 52 and the flange 30 engages the sidewall 54 to seal the opening 28. The one or more tabs prevent the inner container 20 from dropping out of the outer cover 50. The friction between the flange 30 and sidewall 54 also provides a retentive force to prevent the package 10 from opening. In the embodiment shown, the sidewall 26 is also angled to a point 42 (best seen in FIG. 7). The point 42 is formed by a bevel 44 around the upper surface 22. Preferably, the bevel 44 is a two-stepped slope as shown best in FIG. 2. The bevel 44 provides clearance during transition between the open and closed positions. The point 42 further provides friction with the outer cover 50 that acts to retain the set relationship between the outer cover 50 and inner container 20. In another embodiment, the point 42 is coated with a highly tactile material to optimize the retentive force and feel of package operation. In still another embodiment, the outer cover 50 forms one or more detents (not shown) for quasi-capturing the point 42 so that the user can feel entry into the position and additional retentive force is generated.

Referring to FIG. 6, to open the package 10, the user simply applies pressure to the package 10 along arrows 70. The finger well 58 facilitates not only easy pinching but insures that the force is applied in an operable location. The pinching force overcomes the forces holding the inner container 20 in the closed position and causes the package 10 to pivot open. In particular, the second region 36 of the inner container 20 moves or arcs towards the upper section 52 of the outer cover 50 and the first region 34 moves away or arcs away from the upper section 52 along arrow 72. As a result, the opening 28 slides past the sidewall 54 of the outer cover 50 so that a product 12 can be accessed or dispensed. In the open position, the second region 36 is flush against the upper section 52 and the opening 28 is below the sidewall 54 and the product 12 can be dispensed. The point 42 may be in a detent, if provided. The user may also have further indication that the open position has been achieved by the flange 30 clicking past the sidewall 54.

To dispense the product 12 once open, the user taps or shakes the package 10. For pouch products as shown, the pouch product 12 may be partially exposed and, if not desired, pushed backed into the package 10.

To close the package 10, the user simply applies pressure to the inner container 20 of the package 10 along arrow 74. Again, the finger well 56 facilitates easy pinching and insures that the force is applied in an operable location. The pinching force causes the package 10 to pivot closed. In particular, the first region of the inner container 20 moves or arcs toward the upper section 52 of the outer cover 50 until contact between the two occurs. At the same time, the second region 36 moves away or arcs away from the upper section 52. As a result, the opening 28 slides into the sidewall 54 of the outer cover 50 so that the opening 28 becomes resealed.

As can be seen, the apex region 32 functions as a rocking mechanism. In another embodiment, the apex region 32 is a socket for engaging a ball on the upper section 52 to retain the inner container 20 within the outer cover 50 and allow motion between the open and closed positions. In another embodiment, an elastic material, preferably around the apex region 32, extends from the inner container 20 to the outer cover 50 to retain the inner container 20 within the outer cover 50. In still another embodiment, the apex region 32 is configured to rock within a groove or V-shaped channel formed in the upper section 52 of the outer cover 50. The shape of the package 10 may also vary such as, without limitation, a rectangular, square, round, hexagonal, or pentagonal shape.

It addition to the advantages noted above, the disclosed packages provide a novel experience for users when consuming products such as, for example, smokeless tobacco. Moreover, the construction and operation of the cover allows the graphic present on the top surface to be visible at all times during opening and closing of the packages.

While the present invention has been described in terms of specific embodiments thereof, it will be understood that no limitations are intended thereby to the details of construction or design, the present invention contemplating and including any novel feature or novel combination of features which are herein disclosed.

What is claimed is:

1. A package comprising:

a) a container that includes: an upper surface, a lower surface opposing to the upper surface, and a container sidewall extending between the upper and lower surfaces to define an interior for storing a plurality of products, wherein the upper surface has an apex intermediate a first region and a second region, the container sidewall defining an opening sized and configured to release at least one of the products;

b) an outer cover that includes: an upper section and a cover sidewall depending from the upper section, the outer cover being configured to retain the container and selectively seal the opening; and c) a flange around the opening of the container side wall to sealingly engage the cover sidewall, wherein, in a closed position, the first region of the upper surface of the container is flush against the upper section of the outer cover and the cover sidewall of the outer cover seals the opening in the container sidewall, in an open position, the second region of the upper surface of the container is flush against the upper section of the outer cover and the opening in the container sidewall extends beyond the cover sidewall and the products can be dispensed, and the container pivots about the apex to transition between the open and closed positions.

2. A package as recited in claim 1, wherein the products are selected from the group consisting of bagged snuff, mints, and chewing gum.

3. A package comprising:

a) a container that includes: an upper surface, a lower surface opposing to the upper surface, and a container sidewall extending between the upper and lower surfaces to define an interior for storing a plurality of products, wherein the upper surface has an apex intermediate a first region and a second region, the container sidewall defining an opening sized and configured to release at least one of the products, and b) an outer cover that includes: an upper section and a cover sidewall depending from the upper section, the outer cover being configured to retain the container and selectively seal the opening, the upper section of the outer cover including a first finger recess formed above the first region which facilitates closing the package and a second finger recess formed above the second region which facilitates opening the package, wherein, in a closed position, the first region of the upper surface of the container is flush against the upper section of the outer cover and the cover sidewall of the outer cover seals the opening in the container sidewall, in an open position, the second region of the upper surface of the container is flush against the upper section of the outer cover and the opening in the container sidewall extends beyond the cover sidewall and the products can be dispensed, and the container pivots about the apex to transition between the open and closed positions.

4. A package as recited in claim 3, wherein a shape of the package is selected from the group consisting of rectangular, square, round, polygonal and combinations thereof.

5. A package as recited in claim 3, wherein the inner container is plastic and the outer cover is selected from the group consisting of tin, paper and plastic.

6. A package as recited in claim 3, further comprising at least one rib on the apex.

7. A package as recited in claim 3, wherein the sidewall of the inner container is beveled and forms a point.

8. A package comprising:

a) a container including a bottom surface and a container sidewall extending around the periphery of the bottom surface to define an interior for storing a plurality of products, wherein: opposed lateral portions of the container sidewall each include an apex, and an end portion of the container sidewall defines an opening sized and configured to allow the products to pass through;

b) an outer cover including an upper section and a cover sidewall depending from the upper section, the outer cover being configured to retain the container and selectively seal the opening; and c) a flange around the opening of the container side wall to sealingly engage the cover sidewall, the cover being adapted and configured for pivoting about the apex of the opposed lateral portions of the container sidewall between a closed position wherein the cover sidewall seals the opening in the container sidewall and an open position wherein the opening formed in the end portion of the container sidewall is exposed and products can be dispensed.

9. A package as recited in claim 8, wherein the container includes an upper surface that has an apex portion that extends between the apex of each of the lateral portions of the container side wall.

* * * * *